US005354638A

United States Patent [19]

Harada

[11] Patent Number: 5,354,638

[45] Date of Patent: Oct. 11, 1994

[54] MAGNETIC CARRIER FOR USE IN ELECTROPHOTOGRAPHIC DEVELOPMENT

[75] Inventor: Hiroshi Harada, Nikaho, Japan

[73] Assignee: TDK Corporation, Tokyo, Japan

[21] Appl. No.: 908,543

[22] Filed: Jun. 30, 1992

Related U.S. Application Data

[63] Continuation of Ser. No. 625,425, Dec. 11, 1990, abandoned.

[30] Foreign Application Priority Data

Dec. 11, 1989 [JP] Japan ..... 1-321027
Jan. 18, 1990 [JP] Japan ..... 2-9187
Oct. 31, 1990 [JP] Japan ..... 2-294338

[51] Int. Cl.[5] ..... G03G 9/113

[52] U.S. Cl. ..... 430/106.6; 252/62.54; 430/108; 430/137

[58] Field of Search ..... 430/106.6, 137, 108

[56] References Cited

U.S. PATENT DOCUMENTS 3,533,835 10/1970 Hagenbach et al. .
3,914,181 10/1975 Berg et al. ..... 430/106.6
4,043,929 8/1977 Gibson et al. .
4,517,268 5/1985 Gruber et al. ..... 430/106.6
4,609,608 9/1986 Solc ..... 430/106.6
4,810,611 3/1989 Ziolo et al. .
4,822,708 4/1989 Machida et al. .

FOREIGN PATENT DOCUMENTS 2121326 8/1972 France .
58-96561 5/1983 Japan .
59-9670 1/1984 Japan .
60-57351 4/1985 Japan .
60-115948 6/1985 Japan .
60-208767 10/1985 Japan .
61-270769 12/1986 Japan .
62-15561 1/1987 Japan .
62-23054 1/1987 Japan .
62-178279 8/1987 Japan .
62-229161 10/1987 Japan .
19468 1/1989 Japan .
1140168 6/1989 Japan .
1167852 7/1989 Japan .
1385231 2/1975 United Kingdom .

OTHER PUBLICATIONS

Patent Abstracts of Japan vol. 11, No. 189 (P-587) (2636) 18 Jun. 1987, & JP-A-62 15561 (TDK Corporation) 23 Jan. 1987, *the whole document*-no translation.

Patent Abstracts of Japan vol. 11, No. 15 (P-536) (2462) 16 Jan. 1987, & JP-A-61 190345 (Hitachi Metal Ltd.) 25 Aug. 1986, *the whole document*-no translation.

Xerox Disclosure Journal (J. H. Moriconi et al.) vol. 1 No. 4 p. 55 Apr. 1976.

*Primary Examiner*—Christopher D. Rodee
*Attorney, Agent, or Firm*—Oblon, Spivak, McClelland, Maier & Neustadt

[57] ABSTRACT

A magnetic carrier in the form of magnetic particles having a resinous coating on the surface thereof is used in combination with a toner for electrophotographic development. The resinous coating is predominantly comprised of a copolymer of an alkyl (meth)acrylate and styrene in which the alkyl group has 1 to 5 carbon atoms and the content of styrene ranges from 5 to 45% by weight of the copolymer. The copolymer is prepared by emulsion polymerization of alkyl (meth)acrylate and styrene monomers in the presence of a polymerizable emulsifier. The coating becomes tough by heat treating at a temperature of 100° to 300° C.

6 Claims, 7 Drawing Sheets

MAGNETIC CARRIER FOR USE IN ELECTROPHOTOGRAPHIC DEVELOPMENT

This application is a continuation of application Ser. No. 07,625,425, filed on Dec. 11, 1990.

This invention relates to magnetic carrier particles for use in electrophotographic development, especially magnetic brush development.

BACKGROUND OF THE INVENTION

Typical magnetic carrier for use in electrophotographic magnetic brush development along with toner is iron powder and ferrite particles having a resinous coating. The magnetic carrier is effective in triboelectrically charging the toner whereby the toner adheres to the carrier by an electrostatic force and then transferred to a photoconductor upon development.

Therefore, the magnetic carrier particles are required to have a sufficient triboelectric charge in a uniform manner to pick up the toner uniformly for subsequent deposition. The carrier particles should be efficient in carrying the toner in the developing unit and be free flowing powder.

Further, the carrier particles function as one electrode in the developing zone for producing a uniform electric field. They are thus required to have a desired resistance for a particular type of copying machine within the range of from $10^5$ to $10^{12}$ Ω by changing the composition of magnetic particles on which a resinous coating is applied or changing the composition of the resinous coating on magnetic particles. It is desired that the electric resistance of the carrier particles do not lower under humid conditions.

Another requirement imposed on the carrier is durability in that the carrier can maintain and perform its function consistently in the developing unit.

The prior art resinous coatings on magnetic particles are not satisfactory in all of these aspects.

The same assignee as the present invention proposed to use as a resinous coating composition an emulsion which is prepared by emulsion polymerizing a monoethylenic monomer in the presence of a polymerizable emulsifier (see Japanese Patent Application Kokai Nos. 270769/1986, 15561/1987 and 23054/1987). The carrier particles covered with such resinous coatings exhibit stable electric resistance and flow properties, have a controlled triboelectric charge, and are resistant against humidity.

However, these resin coated carrier particles still have several problems including a slow rise of triboelectric charging upon replenishment of toner, a change of electric charge with time, and the fusion of toner to carrier (toner spent). After repetitive copying operation over several ten thousand sheets, the image density will lower with time and toner scattering occur.

SUMMARY OF THE INVENTION

A primary object of the present invention is to provide magnetic carrier particles for use in electrophotographic development which show a quick rise of triboelectric charging upon toner replenishment, a minimized change of electric charge with time, and a minimized lowering of image density with time. Another object is to provide magnetic carrier particles which can minimize the fusion and scattering of toner particles. A further object is to provide magnetic carrier particles having a sharp distribution of charge quantity and high coating strength, and causing minimized fog. A further object is to provide magnetic carrier particles which have excellent initial properties and are durable in that they maintain such excellent properties after numerous copying operations.

The present invention provides magnetic carrier particles for use in electrophotographic development, each in the form of a magnetic particle having a resinous coating on the surface thereof. The resinous coating predominantly comprises a copolymer of an alkyl methacrylate and/or acrylate ester and styrene in which the alkyl group has 1 to 5 carbon atoms and the content of styrene ranges from 5 to 45% by weight of the copolymer.

Preferably, the copolymer is prepared by emulsion polymerization in the presence of a polymerizable emulsifier. The polymerizable emulsifier is selected from the group consisting of an allyl alcohol derivative, an acrylic acid derivative, an iraconic acid derivative, a maleic acid derivative, a fumaric acid derivative, an ethylene derivative, and a styrene derivative, and mixtures thereof. The polymerizable emulsifier is present in an amount of 1 to 15% by weight of the copolymer. The copolymer may further contain up to 20% by weight of the copolymer of an ethylenic monomer.

Most often, the resinous coating is 0.1 to 5 μm thick while the magnetic particles are typically of ferrite and have a mean diameter of 10 to 200 μm.

Desirably, the magnetic carrier particles are heat treated at a temperature of 100° to 300° C.

As described herein, the resinous coating on magnetic particles is predominantly formed from a copolymer of a lower alkyl (meth)acrylate ester and a limited proportion of styrene. The use of the specific copolymer is effective as demonstrated in Examples to be described later.

Although the lower alkyl (meth)acrylate/styrene copolymer is encompassed within the scope of the above-listed preceding Japanese patent applications, no illustrative examples thereof are disclosed therein. The benefits of the present invention are unexpected from the preceding applications.

The heat treatment after coating is effective in tailoring the magnetic carrier particles so as to have a sharp distribution of charge quantity and high coating strength. Many other benefits are available including a rapid rise of charging upon toner replenishment, a minimized change with time of charge quantity, a minimized change with time of image density, minimized fog, a minimized quantity of toner spent, and minimized toner scattering.

DESCRIPTION OF THE PREFERRED EMBODIMENTS

Figure 1:
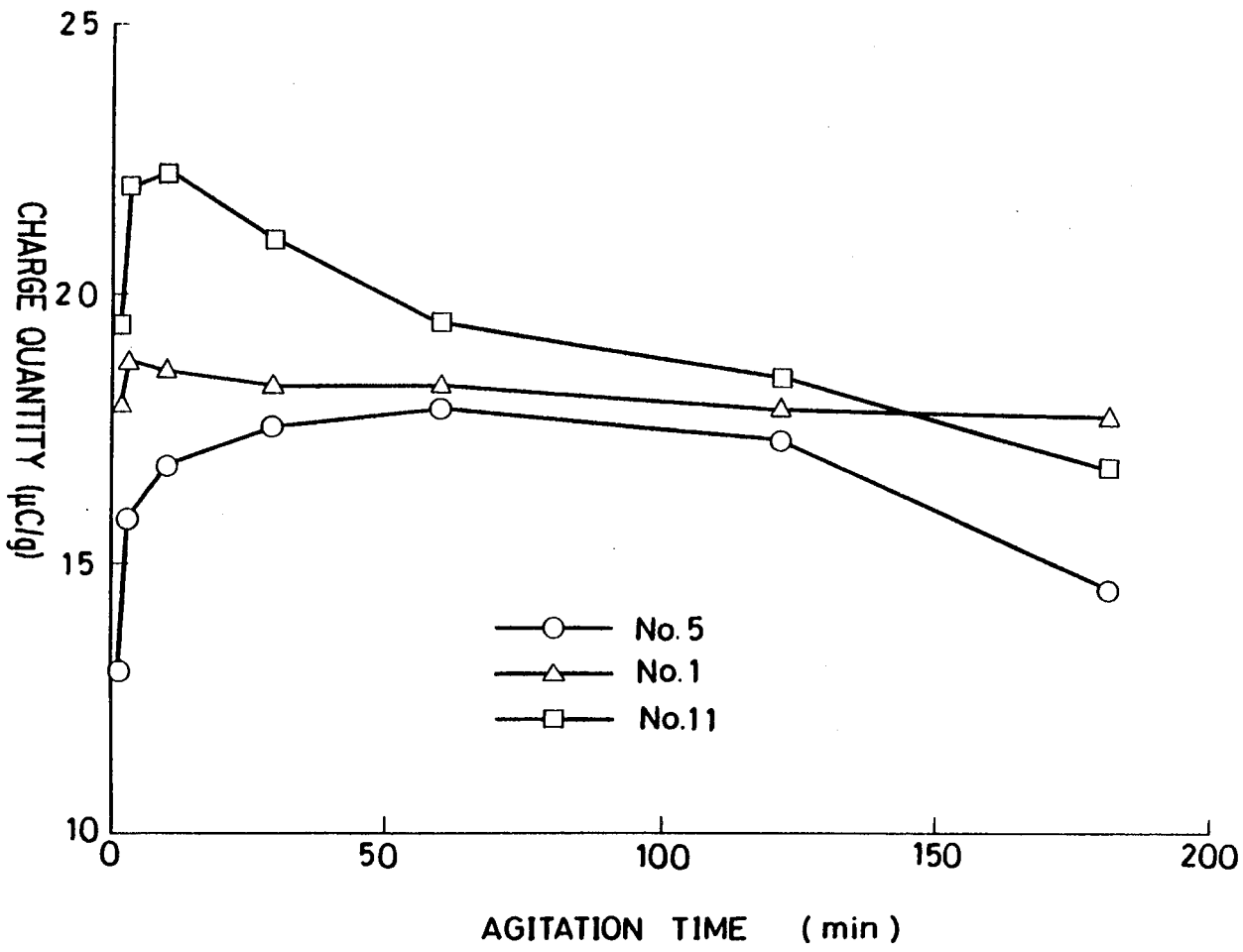
FIG. 1 is a graph showing the electric charge of developers versus the agitating time.

The magnetic carrier for use in electrophotographic development according to the present invention takes the form of magnetic particles each having a resinous coating on the surface thereof. At least the majority of the resinous coating is an acryl-styrene copolymer.

The acrylic monomers used herein are alkyl esters of acrylic or methacrylic acid. The alkyl groups of the esters have 1 to 5 carbon atoms, preferably 1 to 4 carbon atoms. The alkyl groups may be either straight or branched and include, for example, methyl, ethyl, propyl, n-butyl, sec-butyl, tert-butyl, and amyl. The benefits of the present invention are lost if the alkyl group has more than 5 carbon atoms. The acrylic monomers may be used alone or in admixture of two or more.

The acrylic monomers form copolymers with unsubstituted styrene monomers. The content of styrene ranges from 5 to 45%, preferably from 10 to 30% by weight of the copolymer. The benefits of the present invention are lost outside the range.

These copolymers may be prepared solely from an acrylic monomer and a styrene monomer, for example, by solution polymerization. However, the use of a resin emulsion to form the coating is advantageous from mass scale production, safety, efficiency and ease of operation, non-pollution, cost, and other aspects. Therefore, it is preferred to prepare the copolymer as a resin emulsion by emulsion polymerizing an acrylic monomer and a styrene monomer in the presence of a polymerizable emulsifier.

The polymerizable emulsifier used herein is preferably selected from the group consisting of an allyl alcohol derivative, an acrylic acid derivative, an itaconic acid derivative, a maleic acid derivative, a fumaric acid derivative, an ethylene derivative, and a styrene derivative, and mixtures thereof. These polymerizable emulsifiers are illustrated below.

(I) Allyl alcohol derivatives

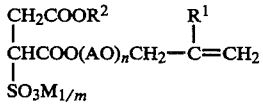

See Japanese Patent Publication No. 46291/1974 and Japanese Patent Application Kokai No. 203960/1983.

$R^1$: hydrogen or a methyl group, $R^2$: a substituted or unsubstituted hydrocarbon group or an organic group including an oxyalkylene group, A: a substituted or unsubstituted alkylene group having 2 to 4 carbon atoms, n: 0 or a positive number, M: an alkali or alkaline earth metal, ammonium, organic amine salt group or organic quaternary ammonium salt group, m: the valence of M.

(I-1)

$n=0,\ R^1=H,\ R^2=C_{12}H_{25},\ M_1/m=Na$ (I-2)

$n=1,\ A=CH_2CH(OH)CH_2,\ R^1=H,\ R^2=C_{12}H_{25},\ M_1/m=Na$ (I-3)

$n=1,\ A=CH_2CH(OH)CH_2,\ R^1=H,\ R^1=C_{18}H_{37},\ M_1/m=Na$ (I-4)

$n=1,\ A=CH_2CH(OH)CH_2,\ R^1=H,\ R^2C_{18}H_{37},\ M_1/m=NH_4$ (I-5)

$n=0,\ R^1=H,\ R^2=CH_2CH(C_9H_{19})(C_7H_{15})$ (II) Acrylic acid derivatives $R^1CH{=}C(R^2)CONH{-}SO_3M$ See Japanese Patent Publication No. 12472/1971.

$R^1$, $R^2$: hydrogen or an organic residue having 1 to 10 carbon atoms, preferably a hydrocarbon residue, more preferably an alkyl or aryl group, most preferably a methyl or phenyl group, M: an alkali metal, preferably potassium.

(II-1)

$R^1=H,\ R^2=C_{10}H_{21},\ M=K$ (II-2)

$R^1=H,\ R^2=C_{10}H_{21},\ M=Na$ (II-3)

$R^1=H,\ R^2=CH_2,\ M=K$

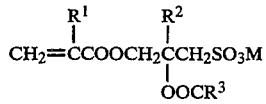

See Japanese Patent Application Kokai No. 144317/1979.

$R^1$, $R^2$: hydrogen or a methyl group, $R^3$: an alkyl or alkenyl group having 7 to 21 carbon atoms, M: an alkali metal or ammonium group.

(II-4)

$R^1=H,\ R^2=H,\ R^3=C_7H_{15},\ M=Na$ (II-5)

$R^1=H,\ R^2=CH_3,\ R^3=C_{21}H_{43},\ M=NH_4$ (II-6)

$R^1=H,\ R^2=H,\ R^3=C_{18}H_{35},\ M=Na$

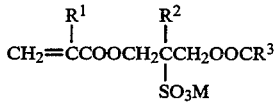

See Japanese Patent Application Kokai No. 11525/1980.

$R^1$, $R^2$: hydrogen or a methyl group, $R^3$: a saturated or unsaturated aliphatic hydrocarbon group having 1 to 21 carbon atoms, M: an alkali metal or ammonium group.

(II-7)

$R^1=H,\ R^2=CH_3,\ R^3=C_{12}H_{25},\ M=Na$ (II-8)

$R^1=H,\ R^2=H,\ R^3=C_{12}H_{25},\ M=K$ (II-9)

$R^1=CH_3,\ R^2=CH_3,\ R^3=C_{18}H_{37},\ M=NH_4$

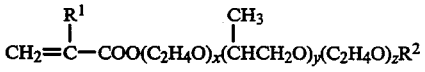

See Japanese Patent Application Kokai No. 28208/1981.

$R^1$, $R^2$: hydrogen or a methyl group, x, y, z: 0 or an integer of up to 100, $1 \leqq x+y+z \leqq 100$.

(II-10)

$R^1=H,\ R^2=CH_3,\ x=20,\ y=20,\ z=30$ (II-11)

$R^1=H,\ R^2=H,\ x=30,\ y=30,\ z=40$ (II-12)

$R^1=H,\ R^2=CH_3,\ x=30,\ y=20,\ z=30$

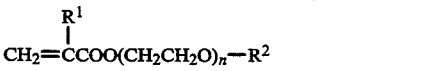

See Japanese Patent Application Kokai No. 41684/1980.

$R^1$: hydrogen, lower alkyl, phenyl or halogen, $R^2$: hydrogen or lower alkyl, n: an integer of from 5 to 25.

(II-13)

$R^1=CH_3,\ R^2=H,\ n=2$ (II-14)

$R^1=CH_3,\ R^2=H,\ n=5$ (II-15)

$R^1=CH_3,\ R^2=H,\ n=9$ (III) Iraconic acid derivatives

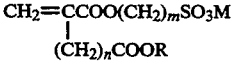

See Japanese Patent Publication No. 34894/1971.

R: an alkyl group having 1 to 22 carbon atoms, a group of formula (i): $CH_2(CF_2)_xH$ wherein x is an even integer of from 2 to 10, or a group of formula (ii):

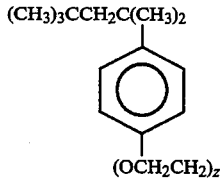

wherein z is an integer of from 1 to 40,

M: hydrogen or an alkali metal, m: an integer of from 2 to 4, n: 1 or 2.

(III-1)

$R=(i),\ x=10,\ M=K,\ m=3,\ n=1$ (III-2)

$R=(i),\ x=5,\ M=K,\ m=3,\ n=1$ (III-3)

$R=(ii),\ z=12,\ M=Na,\ m=3,\ n=1$

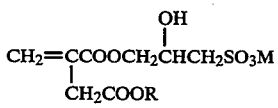

See Japanese Patent Publication No. 44157/1976.

R: a hydrocarbon group having 8 to 22 carbon atoms,

M: an alkali metal or ammonium group.

(III-4)

$R=C_{12}H_{25},\ M=Na$ (III-5)

$R=C_{18}H_{37},\ M=Na$ (III-6)

$R=C_{12}H_{25},\ M=NH_4$

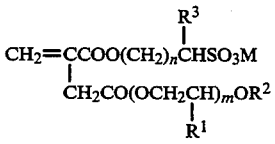

See Japanese Patent Application Kokai No. 30284/1976.

$R^1$: hydrogen or an alkyl group having 1 to 4 carbon atoms, $R^2$: hydrogen or an alkyl group having 1 to 22 carbon atoms, m: an integer of from 1 to 150, $R^3$: hydrogen or methyl, n: 1 to 3 when $R^3$ is H, 2 when $R^3$ is methyl, M: a monovalent cation such as an alkali metal or ammonium salt group.

(III-7)

$R^1=H,\ R^2=C_{12}H_{25},\ R^3=H,\ M=Na,\ m=5,\ n=3$ (III-8)

$R^1=H,\ R^2=C_{18}H_{37},\ R^3=H,\ M=Na,\ m=3,\ n=1$ (III-9)

$R^1=H,\ R^2=C_{12}H_{25},\ R^3=H,\ M=NH_4,\ m=5,\ n=3$ (IV) Maleic acid derivatives

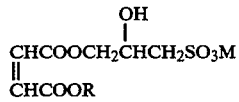

See Japanese Patent Publication No. 44157/1976.

R: a hydrocarbon group having 8 to 22 carbon atoms,

M: an alkali metal or ammonium group.

(IV-1)

$R=C_{12}H_{25},\ M=Na$ (IV-2)

$R=C_{18}H_{37},\ M=K$ (IV-3)

$R=C_{18}H_{37},\ M=NH_4$

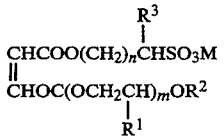

See Japanese Patent Application Kokai No. 30284/1986.

$R^1$: hydrogen or an alkyl Group having 1 to 4 carbon atoms, $R^2$: hydrogen or an alkyl Group having 1 to 22 carbon atoms, m: an integer of from 5 to 150, $R^3$: hydrogen or methyl, n: 1 to 3 when $R^3$ is H, 2 when $R^3$ is methyl, M: a monovalent cation such as an alkali metal or ammonium salt group.

(IV-4)

$R^1=H,\ R^2=C_{12}H_{25},\ R^3=H,\ M=Na,\ m=5,\ n=2$ (IV-5)

$R^1=H,\ R^2=C_{18}H_{37},\ R^3=H,\ M=Na,\ m=5,\ n=2$ (IV-6)

$R^1=H,\ R^2=C_{12}H_{25},\ R^3=H,\ M=NH_4,\ m=5,\ n=2$

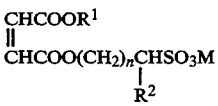

See Japanese Patent Publication No. 29657/1981.

$R^1$: an aliphatic alcohol, aromatic alcohol or ether alcohol residue having 6 to 22 carbon atoms, $R^2$: hydrogen or methyl, n: 2 or 3 when $R^2$ is H, 2 when $R^2$ is methyl, M: a monovalent cation such as hydrogen, an alkali metal or ammonium.

(IV-7)

$R^1=C_8H_{17},\ R^2=H,\ n=3,\ M=Na$ (IV-8)

$R^1=C_{12}H_{25},\ R^2=H,\ n=3,\ M=K$ (IV-9)

$R^1=C_{16}H_{33},\ R^2=H,\ n=3,\ M=NH_4$ (V) Fumaric acid derivatives

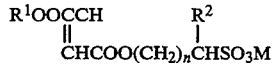

See Japanese Patent Application Kokai No. 30285/76.

$R^1$: an aliphatic alcohol, aromatic alcohol or ether alcohol residue having 1 to 22 carbon atoms, $R^2$: hydrogen or methyl, n: 1 to 3 when $R^2$ is H, 2 when $R^2$ is methyl, M: a monovalent cation such as an alkali metal or ammonium salt group.

(V-1)

$R^1=C_8H_{17},\ R^2=H,\ M=Na,\ n=2$ (V-2)

$R^1=C_{12}H_{25},\ R^2=H,\ M=Na,\ n=2$ (V-3)

$R^1=C_{16}H_{33},\ R^2=H,\ M=Na,\ n=2$

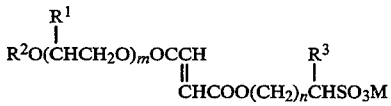

See Japanese Patent Application Kokai No. 30284/1976.

$R^1$: hydrogen or an alkyl Group having 1 to 4 carbon atoms, $R^2$: hydrogen or an alkyl group having 1 to 22 carbon atoms, m: an integer of from 5 to 150, $R^3$: hydrogen or methyl, n: 1 to 3 when $R^3$ is H, 2 when $R^3$ is methyl, M: a monovalent cation such as an alkali metal or ammonium salt group.

(V-4)

$R^1=H,\ R^2=C_{12}H_{25},\ R^3=H,\ M=Na,\ m=5,\ n=2$ (V-5)

$R^1=H,\ R^2=C_{18}H_{37},\ R^3=H,\ M=Na,\ m=5,\ n=2$ (V-6)

$R^1=H$, $R^2=C_{12}H_{25}$, $R^3=H$, $M=NH_4$, $m=5$, $n=2$ (VI) Styrene derivatives

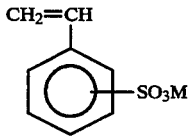

M: a monovalent cation such as an alkali metal or ammonium group.

(VI-1) $M=NH_4$ (VI-2) M=Na (VII) Ethylene derivatives

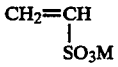

M: a monovalent cation such as an alkali metal or ammonium group.

(VII-1) $M=NH_4$

Among the above-mentioned polymerizable emulsifiers, allyl alcohol derivatives are most preferred.

The polymerizable emulsifiers may be used alone or in admixture of two or more. They are used in such amounts to range from 1 to 15%, more preferably 1 to 10% by weight of the resulting copolymers in the resin emulsions. Less than 1% by weight of polymerizable emulsifier would be too small for emulsion polymerization purposes whereas copolymers containing more than 15% by weight of polymerizable emulsifier would be inconvenient because the electric resistance largely depends on humidity and the charge quantity lowers.

Conventional non-polymerizable emulsifiers may be used along with the above-specified polymerizable emulsifiers. Such non-polymerizable emulsifiers include sodium lauryl sulfate, ammonium lauryl sulfate, sodium polyoxyethylene alkyl ether sulfate, sodium dodecylbenzenesulfonate, sodium dioctylsulfosuccinate, polyoxyethylene nonylphenyl ether, etc.

In addition to the acrylic and styrene monomers, the copolymer may contain another ethylenic monomer.

Illustrative examples of the ethylenic monomers which can be used herein are shown below.

(A) Styrene derived vinyl monomers

Included are α- or β-alkyl substituted styrenes such as α-methylstyrene and β-ethylstyrene; nuclearly alkyl substituted styrenes such as 4-methylstyrene, 2-ethylstyrene, and 4-hexylstyrene; nuclearly halo-substituted styrenes such as chlorostyrene, dichlorostyrene, fluorostyrene, and bromostyrene; nuclearly alkoxy substituted styrenes such as methoxystyrene; nuclearly acyl substituted styrenes such as acetylstyrene; nitrostyrene, etc.

(B) Acrylic vinyl monomers

Included are (meth)acrylic acid; and esters of (meth-)acrylic acid with alcohols such as alkyl alcohols in which the alkyl moiety has more than 5 carbon atoms, halogenated alcohols, alkoxy alcohols, aralkyl alcohols, and alkenyl alcohols. Examples of the alcohols include alkyl alcohols such as hexyl alcohol, 2-ethylhexyl alcohol, heptyl alcohol, octyl alcohol, nonyl alcohol, dodecyl alcohol, tetradecyl alcohol, and hexadecyl alcohol; halogenated alkyl alcohols such as partially halogenated ones of the foregoing alkyl alcohols; alkoxyalkyl alcohols such as methoxyethyl alcohol, ethoxyethyl alcohol, ethoxyethoxyethyl alcohol, methoxypropyl alcohol, and ethoxyrpropyl alcohol; aralkyl alcohols such as benzyl alcohol, phenyl ethyl alcohol, and phenyl propyl alcohol; and alkenyl alcohols such as allyl alcohol and crotonyl alcohol.

(C) Cyan vinyl monomers

Included are acrylonitrile; α-alkylacrylonitriles such as methacrylonitrile and α-ethylacrylonitrile; α-halogenated acrylonitriles such as α-chloroacrylonitrile and α-bromoacrylonitrile; vinylidene cyanide, etc.

Also included in the ethylenic monomers are monomers having a functional Group capable of crosslinking. The ethylenic monomers having a crosslinkable functional group include (D) epoxy-containing monomers, i.e., monomers having an epoxy-containing Group such as Glycidyl, (E) polyfunctional monomers having a plurality of groups having a double bond at the end such as methacryloyl, acryloyl, allyloxy, vinyl, and allyl Groups, (F) hydroxy-containing monomers, i.e., monomers having a hydroxy-containing group such as methylol and hydroxyl, (G) basic monomers containing an amino or imino group such as carbamoyl and dialkylamino groups, (H) carboxy-containing monomers, i.e., monomers containing a carboxyl group such as carboxyl and carboxymethyl groups, (I) β-diketone-containing monomers, i.e., monomers containing a β-diketone Group such as acetoacetoxy, and (J) organometallic group-containing monomers, i.e., monomers containing an organometallic group, typically silyl groups such as triethoxysilyl, triethoxymethoxysilyl, trimethoxysilyl, and acetoxysilyl. Acrylic acid, methacrylic acid and ethylene are preferred as the monomer skeleton.

Illustrative examples of the functional ethylenic monomers are described below.

(D) Epoxy-containing monomers

Included are α,β-ethylenically unsaturated glycidyl esters and ethers, for example, such as glycidyl (meth)acrylate, diglycidyl itaconate, diglycidyl maleate and fumarate, glycidyl alkyl itaconates, glycidyl alkyl maleares and fumarates wherein the alkyl moiety has 1 to 6 carbon atoms, allyl glycidyl phthalate, allyl glycidyl succinate, mixed glycidyl allyl ethers of bisphenol A, and allyl glycidyl ether.

(E) Polyfunctional monomers

Included are polyesters of ethylenically unsaturated acids with polyhydric alcohols and saccharides, for example, ethylene glycol di(meth)acrylate, butane diol di(meth)acrylate, di- and tri(meth)acrylates of trimethylol propane, di-, tri-, and tetra(meth)acrylates of pentaerythritol, di(meth)acrylate of polymethylene glycol, di(meth)acrylate of polyalkylene ether glycols, and poly(meth)acrylates of erythritol, manitol and sorbitol;

polyvinyl ethers of polyhydric alcohols and saccharides, for example, ethylene glycol divinyl ether, butane diol divinyl ether, di- and trivinyl ethers of trimethylolpropane, di-, tri- and tetravinyl ethers of pentaerythritol, and polyvinyl ethers of sorbitol, erythritol and manitol;

diallyl fearate (maleate), triallyl trimeritate, diallyl phthalate, diallyl isophthalate, dimethallyl phthalate, dimethallyl isophthalate, diallyl monohydrogen phosphate, triallyl phosphate, diallyl monomethyl phosphate, diallyl monoethyl phosphate, diallyl monophenyl phosphate, diallyl monobenzyl phosphate, diallyl monohydrogen phosphite, triallyl phosphite, diallyl monomethyl phosphite, diallyl monophenyl phosphite, and diallyl monobenzyl phosphite;

polyallyl or polymethallyl ethers of polyhydric alcohols and saccharides, for example, di- and triallyl ethers of trimethylol propane, di-, tri- and tetraallyl ethers of pentaerythritol, erythritol polyallyl ether, erythritol polymethallyl ether, arabinose polyallyl ether, arabitol polyallyl ether, xylose polyallyl ether, glycose polyallyl ether, mannose polyallyl ether, manitol polyallyl ether, sorbitol polyallyl ether, inositol polyallyl ether, and sucrose polyallyl ether;

poly(unsaturated acid) amides, for example, triallyl cyanurate, triallyl isocyanurate, methylene bis(meth)acrylamide, ethylenebis(meth)acryleunide, dihydroxyethylenebisacrylamide, and tris(acryloyl)hexahydro-s-triazine; and divinyl ketone, diallyl chlorendate, diallylidene pentaerythritol, diallyl cyanamide, divinyl benzene, and tetraallyloxyethane.

(F) Hydroxy-containing monomers

Included are 2-hydroxyethyl (meth)acrylate, 2-hydroxypropyl (meth)acrylate, 3-hydroxybutyl (meth)acrylate, 3-hydroxybutyl (meth)acrylate, 4-hydroxybutyl (meth)acrylate, 5-hydroxypentyl (meth) acrylate, 6-hydroxyhexyl (meth)acrylate, neopentylglycol mono(meth)acrylate, 3-butoxy-2-hydroxypropyl (meth)acrylate, 2-hydroxy-1-phenylethyl (meth)acrylate, polypropylene glycol mono(meth)acrylate, and glycerine mono(meth)acrylate, and N-methylol derivatives of $\alpha,\beta$-monoethylenically unsaturated carboxylic acid amides, for example, N-methoxymethyl (meth)acryleunide, N-ethoxymethyl (meth)acrylamide, n-propoxymethyl (meth)acrylamide, N-isopropoxymethyl (meth)acrylamide, N-n-butoxymethyl (meth)acrylamide, N-sec-butoxymethyl (meth)acryleunide, N-t-butoxymethyl (meth)acrylamide, and N-isobutoxymethyl (meth)acrylamide.

(G) Basic monomers

Included are diacetone acrylamide, (meth)acrylamide, N,N-dimethylacrylamide, N-n-butoxymethylacrylamide, N-vinylpyrrolidone, N-vinylimidazole, 2-methyl-N-vinylimidazole, 2-vinylpyridine, 3-vinylpyridine, 4-vinylpyridine, 2-vinyl-5-ethylpyridine, dimethylaminoethyl acrylate, dimethylaminoethyl methacrylate, diethylaminoethyl (meth)acrylate, butylaminoethyl (meth)acrylate, dimethylallyl amine, diallyl amine, 7-amino-3,7-dimethyloctyl (meth)acrylate, 2-methyl-5-vinylpyridine, 3-methyl-5-vinylpyridine, 2-butyl-5-vinylpyridine, etc.

(H) Carboxy-containing monomers

Included are $\alpha,\beta$-monoethylenically unsaturated carboxylic acids such as aconitic acid, acrylic acid, methacrylic acid, iraconic acid, maleic acid, fumaric acid, and chrotonic acid.

(I) $\beta$-diketone-containing monomers

Included are allyl acetoacetate, acryl acetoacetate, methacryl acetoacetate, (meth)acryl ethyl acetoacetate, (meth)acryl propyl acetoacetate, etc.

(J) Organometallic group-containing monomers

Included are vinyltrichlorosilane, vinyltrimethoxysilane, vinyltriethoxysilane, vinyltriethoxymethoxysilane, vinyltrisacetoxysilane, $\gamma$-methacryloxypropyltrimethoxysilane.

These optional ethylenic monomers may be used alone or in admixture of two or more and preferably in amounts to range up to 20%, most often up to 10% by weight of the copolymers. The presence of more than 20% by weight of the additional ethylenic monomer can adversely affect emulsion polymerization and results in less desirable copolymers having poor humidity resistance and durability.

In addition to the ethylenic monomers, any other vinyl monomer or oligomer may be used, if necessary, for the purposes of adjusting the glass transition temperature Tg and improving adherence to magnetic particles. These other vinyl monomers or oligomers are used in amounts of up to 50% by weight of the copolymers.

Examples of the vinyl monomer include fatty acid vinyl esters such as vinyl acetate and vinyl propionate; olefins such as ethylene, propylene, butylene, and butadiene; halogenated olefins such as vinyl chloride, vinyl bromide, vinyl fluoride, vinylidene chloride, vinylidene bromide, and vinylidene fluoride; and amides such as acrylamide and methacryleunide.

The other vinyl monomer or oligomer may be contained as a blend with the copolymer or as a component of the copolymer.

For the purpose of adjusting the electric charge magnetic particles bear, the coating may contain a charge control agent such as azine compounds, quaternary ammonium salts, and polyamine resins, if desired. The charge control agent is used in an amount of up to 15% by weight relative to the copolymer.

Preferably, a coating is applied to magnetic particles from a synthetic resin emulsion which is prepared by a emulsion polymerization technique. The emulsion polymerization techniques used herein include batchwise polymerization, dropwise polymerization (using monomers or emulsified monomers), seed polymerization, and multi-stage polymerization techniques. The multi-stage polymerization technique is an advanced technique developed from the former techniques.

The synthetic resin emulsion generally contains 5 to 60% by weight of the synthetic resin or copolymer in particulate form having a particle size of 0.01 to 1 $\mu$m, more preferably 0.02 to 1 $\mu$m. The medium of the emulsion may be water or an alcohol such as methyl alcohol, ethyl alcohol, and isopropyl alcohol or a mixture thereof.

The synthetic resin or copolymer in the emulsion preferably has a glass transition temperature Tg of up to 130° C., more preferably 40° to 130° C.

Using the synthetic resin or copolymer emulsion, magnetic particles are covered with a coating, preferably a continuous coating of the synthetic resin or copolymer which has a radial thickness of 0.1 to 5 $\mu$m, more preferably 0.5 to 3 $\mu$m.

In the practice of the present invention, the coating is applied to the surface of magnetic particles by forming a fluidized or tumbling layer of magnetic particles in a vessel, spraying the emulsion thereto through a nozzle sprayer while heating, and drying the coated particles. The heating temperature is usually about 70° to about 90° C., the coating temperature is about 40° to about 80° C., and the drying temperature is about 40° to about 80° C.

It is desired to heat treat the thus coated particles at a temperature of 100° to 300° C. (above the Tg of the copolymer), more preferably 120° to 280° C., most preferably 160° to 240° C. for about 5 to about 90 minutes. Temperatures of lower than 100° C. are ineffective for the purpose whereas temperatures of higher than 300° C. are detrimental. Heat treatment may be carried out using a fluidized bed, chamber dryer, continuous dryer, rotary kiln or the like. As a result of heat treatment, the carrier particles have a narrow distribution of electric charge and an increased coating strength. The charge quantity increases and the electric resistance lowers as the heat treating temperature rises. The charge quantity and electric resistance can be controlled to a desired value by a proper choice of heat treating temperature.

The addition of film forming aids is useful in forming more uniform continuous coatings. Preferred film forming aids are diethylene glycol monobutyl ether acetate, butyl carbitol acetate, cellosolve, cellosolve acetate, butyl cellosolve, butyl cellosolve acetate, phenyl cellosolve, carbitol, carbitol acetate, butyl carbitol, diethyl carbitol, dibutyl carbitol, hexylene glycol, Texanol®, Shellsol®, 3-methoxybutyl acetate, ethylene glycol acetate; monohydric to polyhydric alcohols and derivatives such as benzyl alcohol, furfuryl alcohol, etc.; and aromatic hydrocarbons such as toluene and xylene. Preferably the film forming aids are present in the coatings in amounts of 1 to 20% by weight relative to the weight of the copolymers.

The presence of film forming aids allows the resin component to swell in the emulsion and thus enables coating of a synthetic resin having a higher glass transition temperature.

Further, the coating may contain about 0.1 to about 30% by weight of carbon black as a resistance control agent and about 0.1 to about 30% by weight of a metal complex as a charge control agent, if desired.

The magnetic particles used herein may be made of any desired magnetic material. Most often, powders of oxides having a spinel or hexagonal structure are used as well as iron powder. The oxides having a spinel structure are typically soft ferrites such as 2–3 spinel and 1–3 spinel, magnetite ($Fe_3O_4$), and maghemite ($\gamma$-$Fe_2O_3$). The soft ferrites may contain at least one member selected from Ni, Mn, Mg, Zn, Cu, and Co. The oxides having a hexagonal structure are typically barium ferrite and strontium ferrite and modified Ba and Sr ferrites having Ba, Sr and Fe partially replaced by another metal.

The magnetic powder is prepared as particles having an average diameter of 10 to 200 $\mu$m by a well-known method. No particular limitation is imposed on the particle size distribution.

The magnetic carrier in the form of coated magnetic particles according to the present invention generally has an electric charge quantity of 5 to 45 $\mu$C/g (C: coulomb). The carrier has a fluidity of 25 to 35 sec./50 g as measured by weighing 50 grams of the carrier, charging a powder fluidity meter with it, and determining the falling rate. The carrier has an electric resistance of about $10^5$ to about $10^{12}\,\Omega$ in the voltage range of from 100 to 1000 volts. The carrier has a saturation magnetization ($\sigma_m$) of about 35 to about 95 emu/g.

The carrier of the present invention is combined with the toner to form a developer which is ready for use in electrophotographic development. The type and amount of the toner which can be combined with the present carrier are not particularly limited.

Also, no particular limitation is imposed on the magnetic brush development technique and the type of photoconductor which are used in development to produce electrostatic duplicate images.

EXAMPLE

Examples of the present invention are given below by way of illustration and not by way of limitation.

Example 1

The magnetic particles used were ferrite particles having a mean diameter of 100 $\mu$m, $\sigma_m$=50 emu/g, and Hc=2.0 Oe. The ferrite had the composition: 12 mol % MgO, 8 mol% CuO, 27 mol % ZnO, and 53 mol % $Fe_2O_3$. A fluidized bed of the ferrite particles was formed in a vessel of a tumbling/fluidizing coating apparatus and preheated at 50° C.

Various synthetic resin emulsions were sprayed at 50° C. over the fluidized bed to coat the particles with the resin. The coated particles were then dried.

In each run, the coating was formed of a copolymer which consisted essentially of alkyl (meth)acrylate and styrene in the proportion (parts by weight) shown in Table 1 and which additionally contained an ethylenic monomer and a polymerizable emulsifier in the amounts (% by weight) shown in Table 1.

The emulsion contained 35 to 45% by weight of the resin or copolymer in particulate form having a mean particle size of 0.04 $\mu$m. Butyl carbitol acetate was added in an amount of 5% by weight to the emulsion for assisting in forming a film around magnetic particles.

It was found that the ferrite particles had a uniform continuous coating of 0.6 to 1.2 $\mu$m thick.

TABLE 1

| Carrier | Copolymer composition (pbw) | | Ethylenic monomer (wt %) | Polymerizable emulsifier (wt %) |
|---|---|---|---|---|
| 1 | Ethyl methacrylate | (80) | Glycidyl methacrylate (1.5) | I-1 (1.5) |
| | styrene | (20) | | |
| 2 | t-butyl methacrylate | (80) | Glycidyl methacrylate (1.5) | I-1 (1.5) |
| | Styrene | (20) | | |
| 3 | Methyl methacrylate | (80) | Glycidyl methacrylate (3) | I-1 (1.5) |
| | Styrene | (20) | | |
| 4 | Ethyl methacrylate | (80) | Glycidyl methacrylate (3) | II-15 (6) |
| | styrene | (20) | | |
| 5* | Methyl methacrylate | (90) | Glycidyl methacrylate (3) | I-1 (6) |
| | Acrylonitrile | (10) | | |
| 6* | Ethyl methacrylate | (100) | Glycidyl methacrylate (1.5) | I-1 (1.5) |
| 7 | Ethyl methacrylate | (90) | Glycidyl methacrylate (1.5) | I-1 (1.5) |
| | styrene | (10) | | |
| 8 | Ethyl methacrylate | (70) | Glycidyl methacrylate (1.5) | I-1 (1.5) |
| | styrene | (30) | | |
| 9 | Ethyl methacrylate | (60) | Glycidyl methacrylate (1.5) | I-1 (1.5) |
| | styrene | (40) | | |
| 10* | Ethyl methacrylate | (50) | Glycidyl methacrylate (1.5) | I-1 (1.5) |
| | styrene | (50) | | |
| 11* | Ethyl methacrylate | (30) | Glycidyl methacrylate (1.5) | I-1 (1.5) |
| | styrene | (70) | | |
| 12 | Ethyl methacrylate | (80) | — | I-1 (1.5) |

TABLE 1-continued

| Carrier | Copolymer composition (pbw) | | Ethylenic monomer (wt %) | Polymerizable emulsifier (wt %) |
|---|---|---|---|---|
| | styrene | (20) | | |
| 13 | Ethyl methacrylate | (80) | Dodecyl methacrylate (1) | I-1 (1.5) |
| | styrene | (20) | 2-hydroxy ethyl acrylate (1) | |
| 14 | Ethyl acrylate | (80) | Dodecyl methacrylate (2) | I-1 (1.5) |
| | styrene | (20) | | |

*outside the scope of the invention

A toner was prepared from the following ingredients.

| Ingredient | Parts by weight |
|---|---|
| Styrene-acryl resin (XPA.3115, Mitsui-Toatsu Chemical K.K.) | 89.5 |
| Polypropylene wax (Biscol 550P, Sanyo Chemicals K.K.) | 4.5 |
| Charge control agent (Spiron Black TRH, Hodogaya Chemical K.K.) | 1.5 |
| Carbon black (mean particle size 20 mμm, MA-100, Mitsubishi Chemicals K.K.) | 4.5 |

The ingredients were mixed, melted, milled, cooled, and then crushed by a hammer mill. Further comminution by a jet mill and classification resulted in toner particles having a volume mean diameter d of 11 μm. The toner was obtained by adding 0.3% by weight of silica (R-972, Nihon Aerogel K.K.) to the toner particles and mixing them in a V blender.

A developer was prepared by adding 40 parts by weight of the toner to 1,000 parts by weight of the carrier and agitating the mixture at 100 r.p.m. for one hour.

Using the developer, electrostatic images were developed in a copying machine having a Se photoconductor. The concentration of the toner was monitored by means of a toner sensor. The toner replenisher system was controlled such that 0.5% by weight of a fresh toner was replenished when the toner concentration dropped to 3.5% by weight. The copying machine was continuously operated at 20° C. and RH 60% to duplicate 100,000 copies.

Table 2 shows the electric charge, image density and fog at the end of the 1st and 100,000th copying. The electric charge was measured by taking a sample from the developer at the end of copying, and measuring the electrostatic charge quantity of the sample by means of a blow-off charge tester (manufactured by Toshiba Chemical K.K.) after agitation for 10 seconds.

The quantity of toner spent (by fusing to the carrier) was measured by taking a sample from the developer at the end of copying, separating only the carrier from the sample by air classification, subjecting the carrier to chemical analysis to measure the carbon content (at %). The results are also shown in Table 2.

Toner scattering was visually observed and evaluated in three ratings of "OK", "Fair", and "Poor".

TABLE 2

| | Initial Quality | | | | | Quality After Copying | | | | |
|---|---|---|---|---|---|---|---|---|---|---|
| carrier No. | Charge quantity (μC/g) | Image density | Fog | Carbon content | Sheets | Charge quantity (μC/g) | Image density | Fog | Carbon content | Toner scattering |
| 1 | 24.0 | 1.37 | 0.5 | 0.45 | 100000 | 23.8 | 1.38 | 0.5 | 0.46 | OK |
| 2 | 25.3 | 1.35 | 0.5 | 0.47 | 100000 | 25.0 | 1.35 | 0.5 | 0.47 | OK |
| 3 | 23.1 | 1.38 | 0.6 | 0.43 | 100000 | 22.8 | 1.38 | 0.6 | 0.44 | OK |
| 4 | 24.2 | 1.37 | 0.5 | 0.45 | 100000 | 24.0 | 1.37 | 0.6 | 0.44 | OK |
| 5* | 23.0 | 1.38 | 0.6 | 0.40 | 20000 | 22.1 | 1.40 | 0.9 | 0.41 | Fair |
| 6* | 24.8 | 1.36 | 0.5 | 0.45 | 50000 | 24.3 | 1.38 | 0.8 | 0.45 | Fair |
| 7 | 24.5 | 1.37 | 0.5 | 0.45 | 100000 | 24.3 | 1.38 | 0.6 | 0.45 | OK |
| 8 | 23.8 | 1.38 | 0.5 | 0.45 | 100000 | 23.7 | 1.38 | 0.5 | 0.46 | OK |
| 9 | 23.0 | 1.39 | 0.6 | 0.44 | 100000 | 22.5 | 1.40 | 0.7 | 0.45 | OK |
| 10* | 22.8 | 1.40 | 0.7 | 0.42 | 50000 | 22.7 | 1.40 | 0.9 | 0.44 | Fair |
| 11* | 22.9 | 1.40 | 0.7 | 0.43 | 30000 | 20.9 | 1.41 | 0.9 | 0.45 | Fair |
| 12 | 24.2 | 1.37 | 0.5 | 0.45 | 100000 | 24.0 | 1.37 | 0.6 | 0.45 | OK |
| 13 | 24.5 | 1.36 | 0.5 | 0.46 | 100000 | 24.4 | 1.36 | 0.5 | 0.46 | OK |
| 14 | 24.1 | 1.37 | 0.5 | 0.43 | 100000 | 24.3 | 1.36 | 0.5 | 0.43 | OK |

*outside the scope fo the invention

As seen from Table 2, the samples falling within the scope of the invention not only had excellent quality at the initial, but also showed little change with time of the charge quantity, image density and fog, a minimized quantity of toner spent and little toner scattering even after copying of 100,000 sheets.

In turn, comparative carrier Nos. 5, 6, 10 and 11 in which the copolymer's main composition or compositional ratio was outside the scope of the invention were less durable.

Developers using carrier No. 1 and comparative carrier Nos. 5 and 11, immediately after their preparation, were measured for the rise of charge quantity using a blow-off charge tester. The results are shown in the Graph of FIG. 1. The sample within the scope of the invention showed a rapid rise of charge quantity.

Although the durability and other tests were carried out at 20° C. and RH 60%, equivalent results were obtained under high-temperature, high-humidity conditions of 30° C./RH 80% and low-temperature, low-humidity conditions of 10° C./RH 20%.

Example 2

The same ferrite particles as in Example 1 were used. A fluidized bed of the ferrite particles was formed in a vessel of a tumbling/fluidizing coating apparatus and preheated at 50° C.

Various synthetic resin emulsions were sprayed at 50° C. over the fluidized bed to coat the particles with the resin. The coated particles were then dried, obtaining carrier Nos. 201, 202, and 203. They were heat treated at temperatures of 50° C. and 220° C. for one hour.

In each carrier, the coating was formed of a copolymer which consisted essentially of alkyl (meth)acrylate and styrene in the proportion (parts by weight) shown in Table 3 and which additionally contained an ethylenic monomer and a polymerizable emulsifier in the amounts (% by weight) shown in Table 3.

The emulsion contained 35 to 45% by weight of the resin or copolymer in particulate form having a mean particle size of 0.04 μm. Butyl carbitol acetate was added in an amount of 5% by weight to the emulsion for assisting in forming a film around magnetic particles.

It was found that the ferrite particles had a uniform continuous coating of 0.6 to 1.2 μm thick.

TABLE 3

| Carrier | Copolymer composition (pbw) | | Ethylenic monomer (wt %) | Polymerizable emulsifier (wt %) |
|---|---|---|---|---|
| 201 | Ethyl methacrylate | (80) | Glycidyl methacrylate (1.5) | I-1 (1.5) |
| | Styrene | (20) | | |
| 202 | Methyl methacrylate | (90) | Glycidyl methacrylate (3) | I-1 (6) |
| | Acrylonitrile | (10) | | |
| 203 | Ethyl methacrylate | (80) | Glycidyl methacrylate (3) | I-1 (1.5) |
| | Styrene | (20) | | |

A developer was prepared by adding 40 parts by weight of the same toner as in Example 1 to 1,000 parts by weight of carrier No. 201, 202 or 203 and agitating the mixture at 100 r.p.m. for one hour.

For carrier No. 201 samples heat treated at temperatures of 220° C. and 50° C., a distribution of charge quantity Q/d was measured by the following procedure using a q/d-meter (manufactured by PES Laboratoriurn). First, a holder is filled with a 150 mg sample taken out of the developer and set in the testing machine. By passing air through a cylindrical chamber at a predetermined rate and agitating the developer charge in the holder, the toner is introduced into the cylindrical chamber. An electric field created between a pair of upper and lower electrodes in the chamber causes the charged toner to deflect. The toner adhered to the upper electrode is transferred to an adhesive tape which is optically observed. The distribution of charge quantity of the carrier is plotted using the area of toner adhered per unit electrode area and a distance X from the origin.

Figure 2:
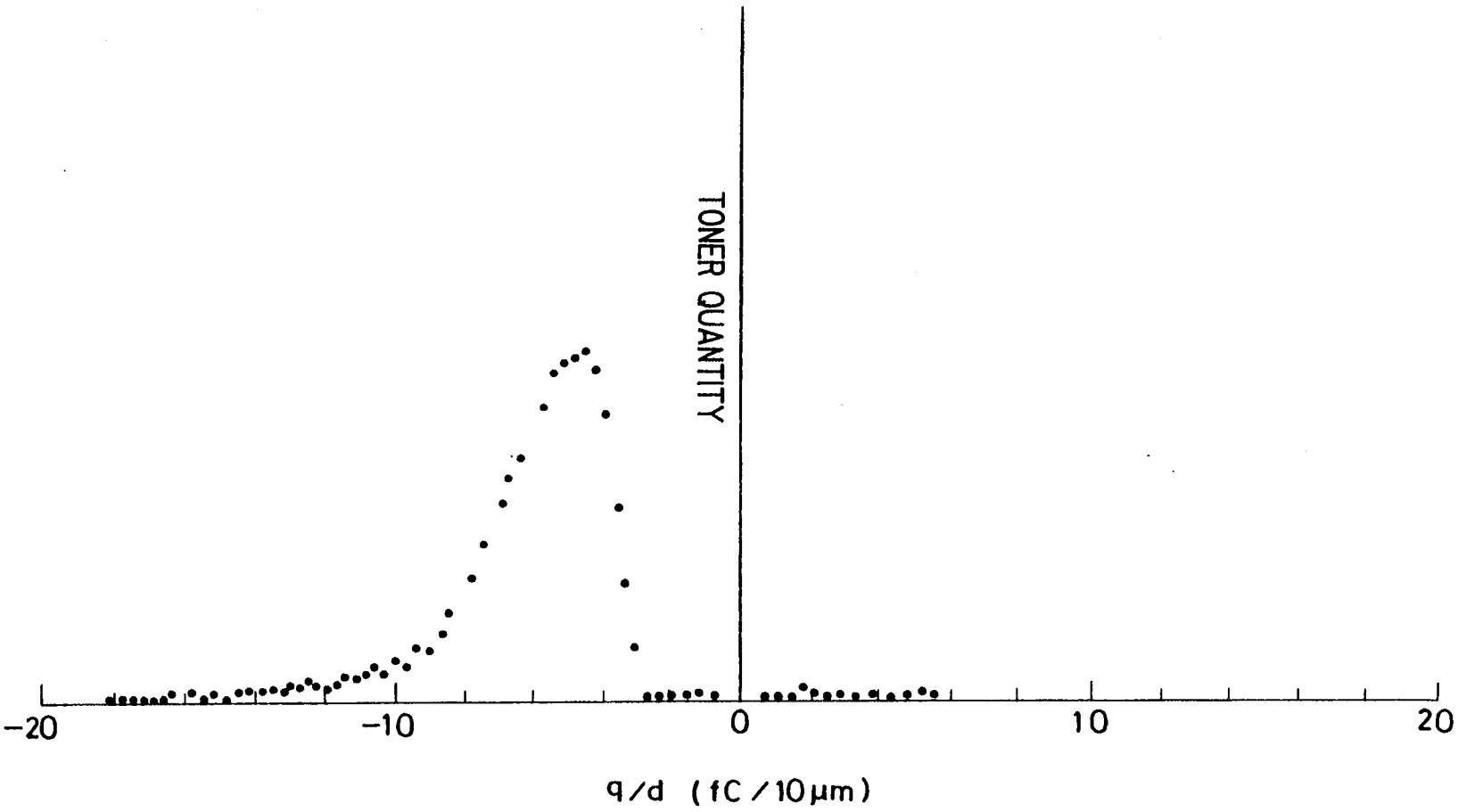
FIG. 2 is a graph showing a charge quantity distribution of carrier particles according to the invention.
Figure 3:
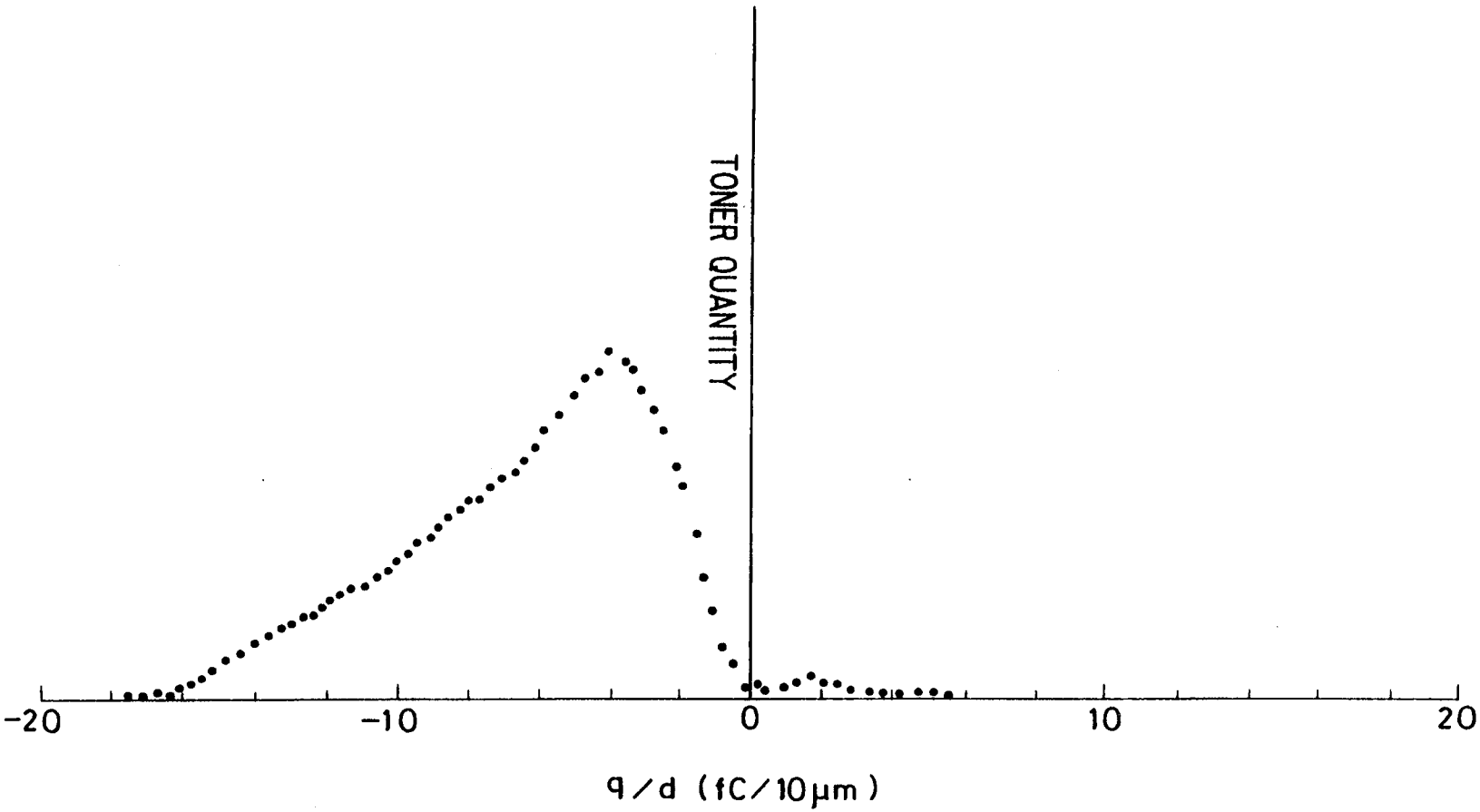
FIG. 3 is a graph showing a charge quantity distribution of carrier particles outside the scope of the invention.

The results are shown in FIG. 2 for the carrier heat treated at a temperature of 220° C. and FIG. 3 for the carrier heat treated at a temperature of 50° C. A comparison of FIGS. 2 and 3 reveals that the heat treatment according to the invention provides a sharp distribution of charge quantity.

Similar results were obtained with carrier Nos. 202 and 203.

Using these developers, electrostatic images were developed in a copying machine having a Se photoconductor. The toner replenisher system was controlled such that 0.5% by weight of a fresh toner was replenished when the toner concentration dropped to 3.5% by weight. The copying machine was continuously operated to duplicate 30,000 sheets at 20° C. and RH 60%, 20,000 sheets at 10° C. and RH 20%, 20,000 sheets at 30° C. and R/{80%, and then 30,000 sheets at 20° C. and RH 60%, duplicating 100,000 copies in total.

Table 4 shows the fog at the first copying and after the continuous copying.

TABLE 4

| Carrier No. | Heat treating temperature | Initial fog | After copying Sheets | fog |
|---|---|---|---|---|
| 201 | 50° C. | 0.8 | 50,000 | 1.1 |
| 201 | 220° C. | 0.5 | 100,000 | 0.5 |
| 202 | 50° C. | 1.0 | 40,000 | 1.3 |
| 202 | 220° C. | 0.6 | 70,000 | 0.8 |
| 203 | 50° C. | 0.9 | 50,000 | 1.2 |
| 203 | 220° C. | 0.6 | 100,000 | 0.6 |

The benefits of the heat treatment at temperatures between 100° C. and 300° C. is evident from Table 4.

Further, carrier Nos. 201, 202 and 203 were heat treated at varying temperatures and examined for the charge quantity relative to the heat treating temperature. The electric charge was measured by taking a sample from the developer at the end of copying, and measuring the electrostatic charge quantity of the sample by means of a blow-off charge tester (manufactured by Toshiba Chemical K.K.) after agitation for 10 seconds.

Figure 4:
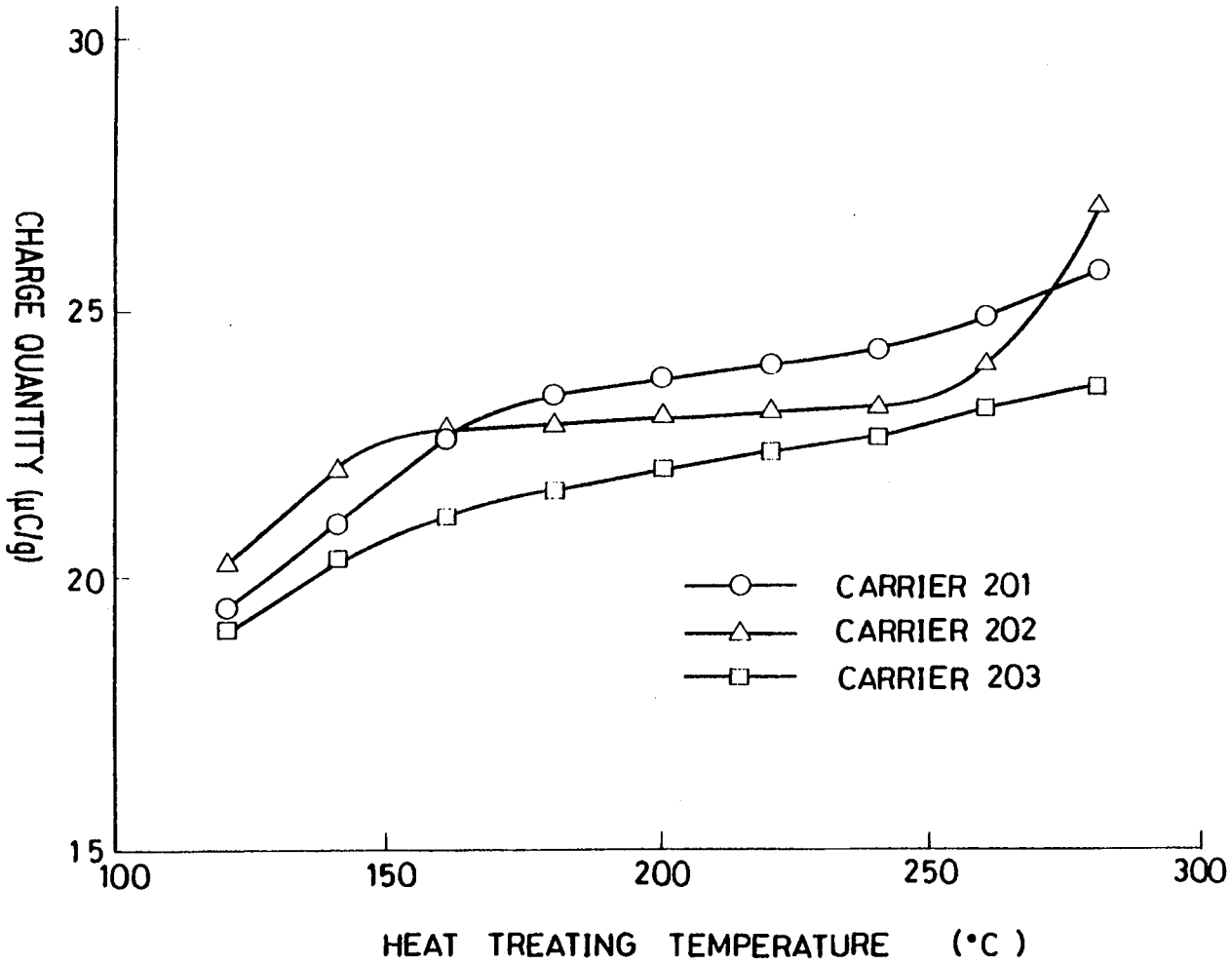
FIG. 4 is a graph showing the charge quantity of carriers versus the heat treating temperature.

The results are shown in FIG. 4.

As seen from FIG. 4, the charge quantity improves in accordance with the heat treatment as defined by the invention and can be controlled to a desired value by a proper choice of the heat treating temperature.

Also, the electric resistance of carrier Nos. 201, 202 and 203 was measured while varying the heat treating temperature.

The electric resistance was measured by opposing N and S poles at a spacing of 5 mm in a manner simulating the magnetic brush development mode. The poles at the opposing surface had a magnetic flux density of 1500 Gauss and a surface area of 10 mm×30 mm. Parallel plate electrodes spaced 2 mm were disposed between the opposed electrodes. A sample (200 mg) was placed between the electrodes and held there by a magnetic force. Then the electric resistance was measured by means of an insulation resistance tester or ammeter.

Figure 5:
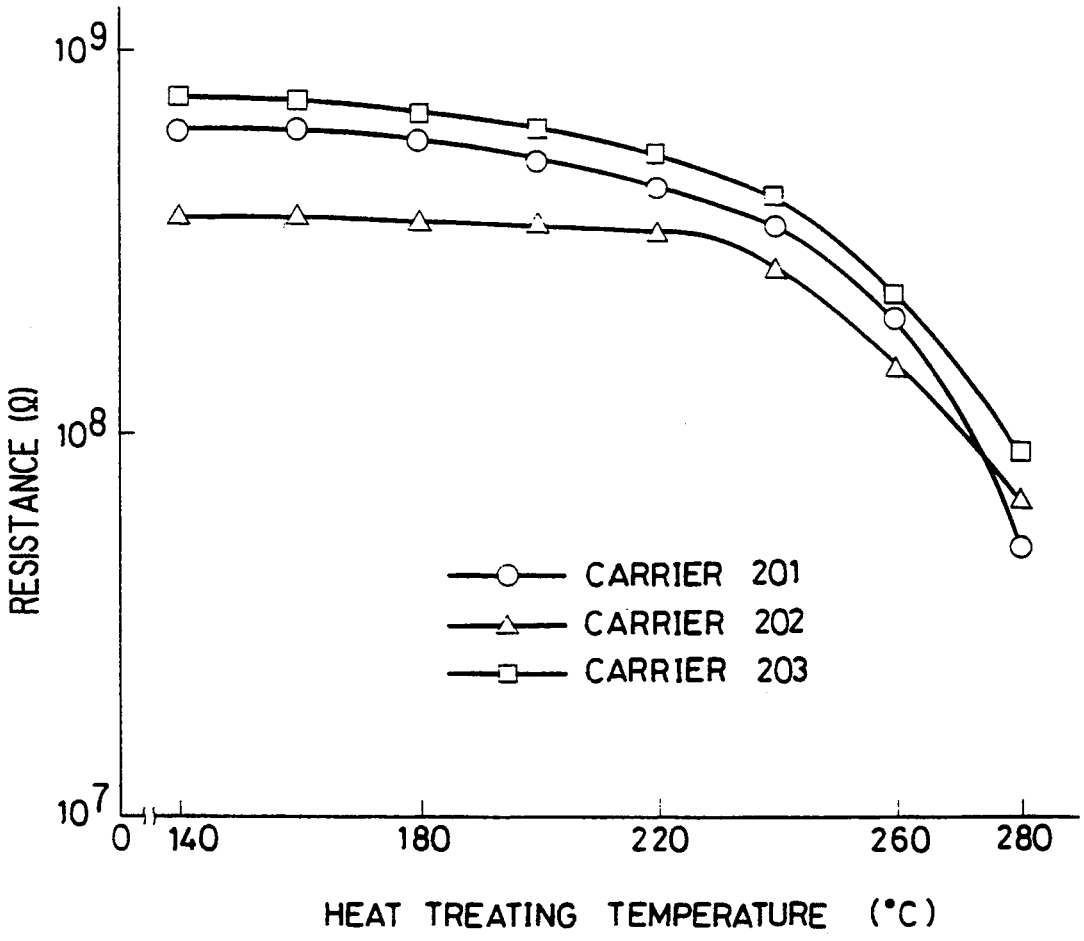
FIG. 5 is a graph showing the electric resistance of carriers versus the heat treating temperature.

The results are shogun in FIG. 5.

As seen from FIG. 5, the electric resistance is maintained at a desired value in accordance with the heat treatment as defined by the invention.

Further, the separation of the coating from carrier Nos. 201, 202 and 203 was determined while varying the heat treating temperature. The quantity of the coating separated from the carrier was determined by placing 200 mg of the carrier in the blow-off charge tester, agitating the carrier for 60 seconds in the tester, and measuring the charge quantity from which the quantity of the coating separated was calculated.

Figure 6:
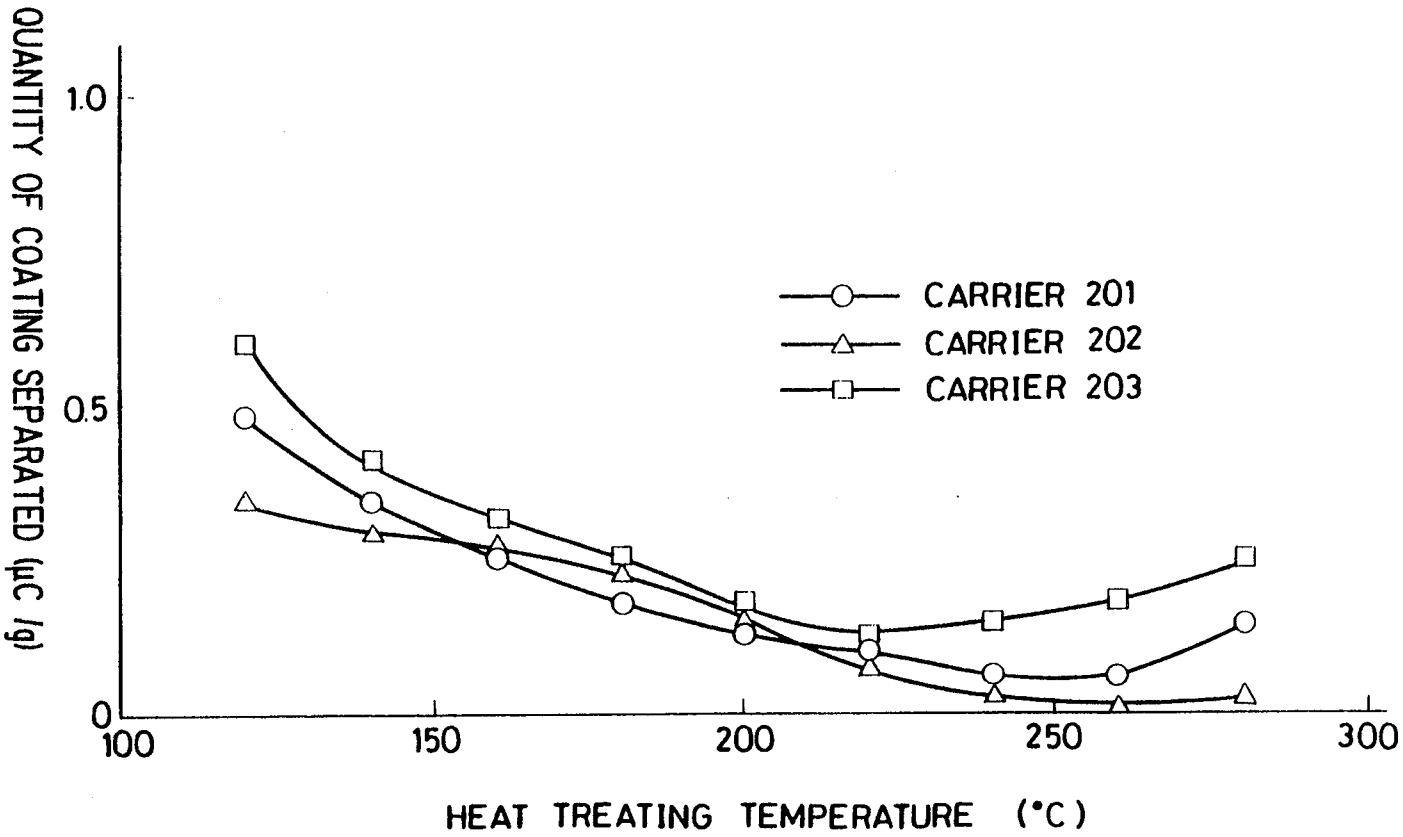
FIG. 6 is a graph showing the coating separation from carriers versus the heat treating temperature.

The results are shown in FIG. 6.

As seen from FIG. 6, the coating strength improves in accordance with the heat treatment as defined by the invention.

Example 3

Carriers were prepared by the same procedure as in Example 2 except that a resinous coating of the composition shown in Table 5 was used and the heat treatment was effected for one hour at the temperature shogun in Table 5.

TABLE 5

| Carrier | Copolymer composition (pbw) | | Ethylenic monomer (wt %) | Polymerizable emulsifier (wt %) | Heat treating temperature (°C.) |
|---|---|---|---|---|---|
| 301 | Ethyl methacrylate | (80) | Glycidyl methacrylate (1.5) | I-1 (1.5) | 220 |
| | Styrene | (20) | | | |
| 302 | Methyl methacrylate | (90) | Glycidyl methacrylate (3) | I-1 (6) | 220 |
| | Acrylonitrile | (10) | | | |
| 303 | Ethyl methacrylate | (80) | Glycidyl methacrylate (3) | I-1 (1.5) | 220 |
| | Styrene | (20) | | | |
| 304 | Ethyl methacrylate | (80) | Glycidyl methacrylate (3) | II-15 (6) | 220 |
| | Styrene | (20) | | | |
| 305 | t-butyl methacrylate | (80) | Glycidyl methacrylate (1.5) | I-1 (1.5) | 200 |
| | Styrene | (20) | | | |
| 306 | Ethyl methacrylate | (100) | Glycidyl methacrylate (1.5) | I-1 (1.5) | 200 |
| 307 | Ethyl methacrylate | (90) | Glycidyl methacrylate (1.5) | I-1 (1.5) | 220 |
| | Styrene | (10) | | | |
| 308 | Ethyl metacrylate | (70) | Glycidyl methacrylate (1.5) | I-1 (1.5) | 220 |
| | Styrene | (30) | | | |
| 309 | Ethyl methacrylate | (60) | Glycidyl methacrylate (1.5) | I-1 (1.5) | 210 |
| | Styrene | (40) | | | |
| 310 | Ethyl methacrylate | (50) | Glycidyl methacrylate (1.5) | I-1 (1.5) | 210 |
| | Styrene | (50) | | | |
| 311 | Ethyl methacrylate | (30) | Glycidyl methacrylate (1.5) | I-1 (1.5) | 210 |
| | Styrene | (70) | | | |
| 312 | Ethyl methacrylate | (80) | — | I-1 (1.5) | 210 |
| | Styrene | (20) | | | |
| 313 | Ethyl methacrylate | (80) | Dodecyl methacrylate (1) | I-1 (1.5) | 220 |
| | Styrene | (20) | 2-hydroxy ethyl acrylate (1) | | |
| 314 | Ethyl acrylate | (80) | Dodecyl methacrylate (2) | I-1 (1.5) | 220 |
| | Styrene | (20) | | | |

A developer was prepared by adding 40 parts by weight of the same toner as in Example 1 to 1,000 parts by weight of each carrier and agitating the mixture at 100 r.p.m. for one hour.

Using these developers, electrostatic images were developed in a copying machine having a Se photoconductor. The toner replenisher system was controlled such that 0.5% by weight of a fresh toner was replenished when the toner concentration dropped to 3.5% by weight. The copying machine was continuously operated to duplicate 30,000 sheets at 20° C. and RH 60%, 20,000 sheets at 10° C. and RH 20%, 20,000 sheets at 30° C. and RH 80%, and then 30,000 sheets at 20° C. and RH 60%, duplicating 100,000 copies in total.

The electric charge, image density and fog were measured at the end of the 1st and 100,000th copying. The measurements of fog are shown in Table 6. The electric charge and image density were satisfactory and stable for all the samples.

The quantity of toner spent (by fusing to the carrier) was measured by taking a sample from the developer at the end of copying, separating only the carrier from the sample by air classification, subjecting the carrier to chemical analysis to measure the carbon content (at %). For all the samples, the carbon content was as low as 0.4 to 0.5 at % both at the initial and after copying.

Toner scattering was visually observed and rated "OK", "Fair", or "Poor" as shown in Table 6.

TABLE 6

| Carrier No. | Initial fog | After copying Sheets | After copying Fog | Toner scattering |
|---|---|---|---|---|
| 301 | 0.5 | 100,000 | 0.5 | OK |
| 302 | 0.6 | 70,000 | 1.0 | Fair |

TABLE 6-continued

| Carrier No. | Initial fog | After copying Sheets | After copying Fog | Toner scattering |
|---|---|---|---|---|
| 303 | 0.6 | 100,000 | 0.6 | OK |
| 304 | 0.6 | 100,000 | 0.7 | OK |
| 305 | 0.5 | 100,000 | 0.6 | OK |
| 306 | 0.5 | 70,000 | 0.9 | Fair |
| 307 | 0.5 | 100,000 | 0.6 | OK |
| 308 | 0.5 | 100,000 | 0.5 | OK |
| 309 | 0.6 | 100,000 | 0.7 | OK |
| 310 | 0.7 | 50,000 | 0.9 | Fair |
| 311 | 0.7 | 30,000 | 0.9 | Fair |
| 312 | 0.5 | 100,000 | 0.6 | OK |
| 313 | 0.5 | 100,000 | 0.5 | OK |
| 314 | 0.5 | 100,000 | 0.5 | OK |

As seen from these Tables, the samples having the preferred copolymer's main composition within the scope of the invention not only had excellent quality at the initial, but also showed little change with time of the charge quantity, image density and fog, a minimized quantity of toner spent and little toner scattering even after copying of 100,000 sheets.

In turn, carrier Nos. 302, 306, 310 and 311 in which the copolymer's main composition or compositional ratio is outside the scope of the invention were less durable.

Figure 7:
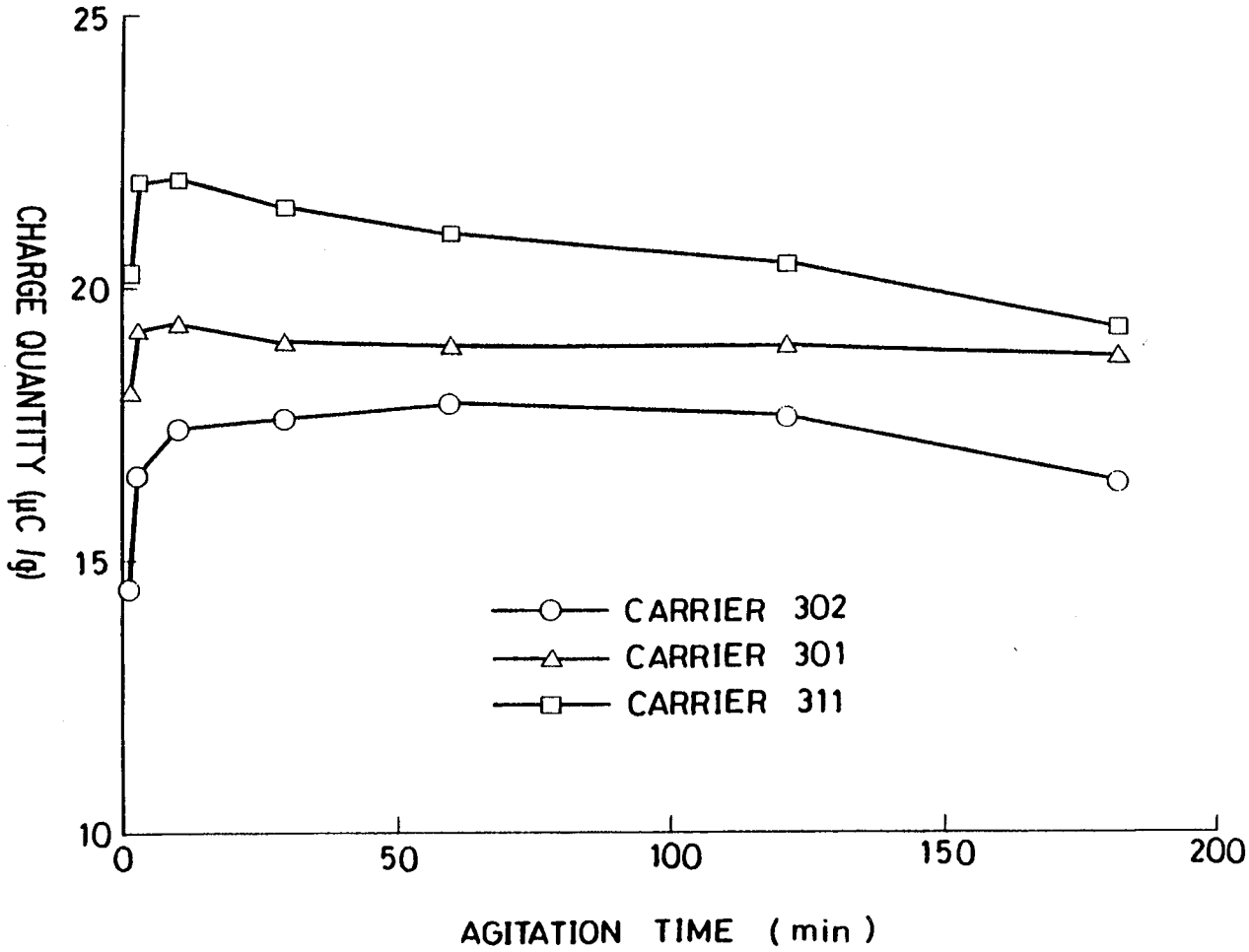
FIG. 7 is a graph showing the electric charge of developers versus the agitating time.

Developers using carrier No. 301 and comparative carrier Nos. 302 and 311, immediately after their preparation, were measured for the rise of charge quantity using a blow-off charge tester. The results are shown in the graph of FIG. 7. The sample within the scope of the invention showed a rapid rise of charge quantity and stable properties.

There have been described magnetic carrier particles which possess excellent properties of charge quantity, electric resistance, and fluidity. In addition, the magnetic carrier particles of the present invention have the following benefits attributable to the selection of a specific copolymer composition. (1) The rise of charging is very rapid while the charge quantity changes little with time. (2) The carrier is quite durable. Even after numerous repetition of copying operations, the charge quantity, charging properties, image density, and fog change little with time. (3) Little wear or separation of the coating occurs and the quantity of toner spent is minimized. These result in minimized toner scattering.

Where the coated magnetic carrier particles are heated treated, a sharper distribution of charge quantity is available and the coating becomes more tough. As a result, fog is minimized.

Although some preferred embodiments have been described, many modifications and variations may be made thereto in the light of the above teachings. It is therefore to be understood that within the scope of the appended claims, the invention may be practiced otherwise than as specifically described.

I claim:

1. In magnetic carrier particles for use in electrophotographic development, each in the form of a magnetic particle having a resinous coating on the surface thereof, the improvement wherein said resinous coating comprises predominantly a copolymer of an alkyl methacrylate and/or acrylate and styrene in which the alkyl group has 1 to 5 carbon atoms and the content of styrene ranges from 5 to 45% by weight of the copolymer, said copolymer being prepared by emulsion polymerization in the presence of a polymerizable emulsifier, said magnetic particles having an average diameter of 10 to 200 μm, and said resinous coating having a thickness from 0.6 to 1.2 μm.

2. The magnetic carrier particles of claim 1 wherein said polymerizable emulsifier is selected from the group consisting of an allyl alcohol derivative, an acrylic acid derivative, an iraconic acid derivative, a maleic acid derivative, a fumaric acid derivative, an ethylene derivative, and a styrene derivative, and mixtures thereof.

3. The magnetic carrier particles of claim 1 wherein said polymerizable emulsifier is present in an amount of 1 to 15% by weight of said copolymer.

4. The magnetic carrier particles of claim 1, wherein said copolymer further contains up to 20% by weight of another ethylenic monomer in addition to the alkyl methacrylate and/or acrylate and styrene monomers.

5. The magnetic carrier particles of claim 1 which have been heat treated at a temperature of 100° to 300° C.

6. The magnetic carrier particles of claim 1 wherein said magnetic particles are of ferrite.

* * * * *

UNITED STATES PATENT AND TRADEMARK OFFICE

CERTIFICATE OF CORRECTION

PATENT NO. : 5,354,638

DATED : October 11, 1994

INVENTOR(S) : Hiroshi HARADA

It is certified that error appears in the above-identified patent and that said Letters Patent is hereby corrected as shown below:

Column 22, line 11, "iraconic" should read --itaconic--.

Signed and Sealed this

Fifth Day of September, 1995

*Attest:*

*Attesting Officer*

Bruce Lehman

BRUCE LEHMAN

*Commissioner of Patents and Trademarks*